United States Patent [19]

Stanton

[11] 4,345,897

[45] Aug. 24, 1982

[54] RECIRCULATING SYSTEM FOR GAS-FIRED FURNACE

[76] Inventor: C. Robert Stanton, 1316 Edwardsville Rd., Granite City, Ill. 62040

[21] Appl. No.: 142,079

[22] Filed: Apr. 21, 1980

[51] Int. Cl.[3] ..... F24H 1/00; F24B 7/00; F16K 15/00

[52] U.S. Cl. ..... 432/72; 126/117; 137/513.5; 165/DIG. 2; 237/55; 432/222

[58] Field of Search ..... 237/55; 126/99 R, 117; 432/72, 222, 223; 165/DIG. 2; 137/513.5

[56] References Cited

U.S. PATENT DOCUMENTS

| | | | |
|---|---|---|---|
| 657,922 | 9/1900 | Edison | 432/223 |
| 1,015,142 | 1/1912 | Criswell | 137/513.5 |
| 2,769,504 | 11/1956 | Miller | 432/222 |
| 2,780,218 | 2/1957 | Allen | 432/223 |
| 3,459,403 | 8/1969 | Royer | 137/513.5 |
| 3,565,406 | 2/1971 | Wollner | 432/223 |
| 3,570,828 | 3/1971 | Cowan | 432/223 |
| 3,777,975 | 12/1973 | Kofink | 432/223 |
| 3,915,587 | 10/1975 | Rannenberg | 137/513.5 |
| 3,995,991 | 12/1976 | Wilkinson | 432/222 |
| 4,011,041 | 3/1977 | Taylor | 432/222 |
| 4,012,191 | 3/1977 | Lisankie | 237/55 |
| 4,098,567 | 7/1978 | Hubbert | 432/223 |
| 4,218,211 | 8/1980 | Caplan | 126/91 A |

*Primary Examiner*—Daniel J. O'Connor

*Attorney, Agent, or Firm*—Pravel, Gambrell, Hewitt, Kirk, Kimball & Dodge

[57] ABSTRACT

Combustion gas recirculating system for a gas-fired furnace of the type which includes a plenum with a cold air inlet duct and a warm air exhaust duct, a combustion chamber where gas is burned to form hot combustion gases, a heat exchanger in the plenum for receiving the hot combustion gases and including an outer surface configuration past which air can flow and be heated, an outlet in the heat exchanger for the hot combustion gases, and a blower for moving air through the plenum and past the heat exchanger. A recirculation duct connects the combustion gas outlet with the cold air inlet duct and a thermostatically controlled valve regulates the flow of hot combustion gases from the combustion gas outlet to the cold air inlet duct by opening when the hot combustion gases reach a predetermined temperature and closing when the hot combustion gases are below said predetermined temperature. A predetermined minimum amount of hot combustion gases bypasses the valve and flows to the cold air inlet duct when the thermostatic valve is closed.

12 Claims, 3 Drawing Figures

RECIRCULATING SYSTEM FOR GAS-FIRED FURNACE

BACKGROUND OF THE INVENTION

This invention relates to gas-fired, forced-air furnaces and, more particularly, to a fuel efficient, hot combustion gas recirculation system which can be built into new furnaces or installed on existing ones.

Forced-air, gas, home furnaces typically include a combustion chamber where gas is burned to produce hot combustion gases. The hot gases flow through a heat exchanger through which air is circulated so that relatively cool returning air is heated and circulated back through the house. After leaving the heat exchanger, the hot combustion gases are normally vented to the atmosphere through a flue which is connected to a chimney or the like.

By venting hot combustion gases to the atmosphere, a significant amount of heat is allowed to escape unused. Without utilizing this heat, energy is in effect wasted which amounts to greater fuel consumption and larger fuel bills.

Attempts to more effectively utilize this heat by rerouting the hot combustion gases both into the hot air exhausting from the heat exchanger and into the cold air being introduced into the heat exchanger have proved unsatisfactory. Connecting the combustion chamber directly into the heat exchanger exhaust caused the gas burners to blow out, apparently because of the strong air flow generated by the blower. Initial attempts to reroute the hot combustion gases into the cold air return to the heat exchanger caused excessive drafts to flow through the combustion chamber, resulting in the burner being blown out. Although a reduction in the gas flow rate to the burners helped the blowout problem, drafts through the combustion chamber cooled the heat exchanger and lowered the efficiency of the furnace.

A damper installed in the flue pipe which would be closed when the burners were off, during warming of the heat exchanger, and when air is circulating through the heat exchanger caused problems, notably warping of the dampers because of excessive heat and burner blowout due to a buildup of pressure within the combustion chamber when the damper is closed.

SUMMARY OF THE INVENTION

A recirculating system for the hot combustion gases of a gas-fired furnace has been developed in accordance with the invention which solves the problems discussed above and conserves energy by utilizing all of the hot combustion gases for heating a building instead of allowing gases in the heat exchanger to escape to the atmosphere.

In accordance with the invention, hot combustion gases are recirculated to the cold air return of the furnace after they pass through the heat exchanger. A thermostatically controlled valve is located in the combustion chamber outlet for regulating the flow of hot combustion gases by opening when the gases are above a predetermined temperature and closing when they are below that predetermined temperature. A preferred valve of this type is one which utilizes a reservoir filled with wax which operates to move a piston in conjunction with a spring for opening and closing a valve outlet.

The thermostatic valve is mounted on a circular support plate which includes a plurality of relief ports so that when the pressure in the combustion chamber increases after the gas burners are ignited, the pressure is relieved by allowing the hot gases to escape through the ports and prevent the burners from blowing out. The hot gases flow into the cold air return and operate to pre-heat the cold air before it reaches the heat exchanger. The thermostatic valve remains closed until just before the blower turns on so that the heat exchanger can reach its operating temperature as quickly as possible. Just before the blower switches on, the thermostatic valve opens and allows the hot combustion gases to circulate into the cold air return. This operation results in less fuel to raise the heat exchanger to its operating temperature and more efficient operation of the furnace because the hot combustion gases are used to heat the house directly.

It has been found that by eliminating the flue which normally communicates the combustion chamber with the outside atmosphere, the cold back-draft of outside air and high moisture content are no longer a problem in the combustion chamber. Acid buildup within the flue and depletion of oxygen to the burners are significantly reduced since water vapor no longer is able to freely enter the combustion chamber. Since there is ample oxygen in the combustion chamber, little if any carbon monoxide is formed so that the hot gases can safely be circulated through the living area of the house when the furnace is properly adjusted.

The energy savings resulting from using the recirculating system described above are significant. For example, in a typical furnace without the recirculating system the average time needed to raise the heat exchanger temperature 40° F. is about 2½ minutes at full capacity rate of consumption of the furnace which, at a gas flow rate of about 18 cubic feet per minute, requires about 45 cubic feet of gas. In a furnace on which the recirculation system has been installed, the same 40° F. increase can be achieved in 3 minutes at a gas flow rate of about 9 cubic feet per minute or a net total gas usage of 27 cubic feet, which represents a 44% gas savings for bringing the heat exchanger up to the temperature where air can effectively be circulated through it.

BRIEF DESCRIPTION OF THE DRAWINGS

A better understanding of the invention can be obtained when the detailed description of a preferred embodiment set forth below is considered in conjunction with the accompanying drawings, in which.

DETAILED DESCRIPTION OF A PREFERRED EMBODIMENT

Figure 1:
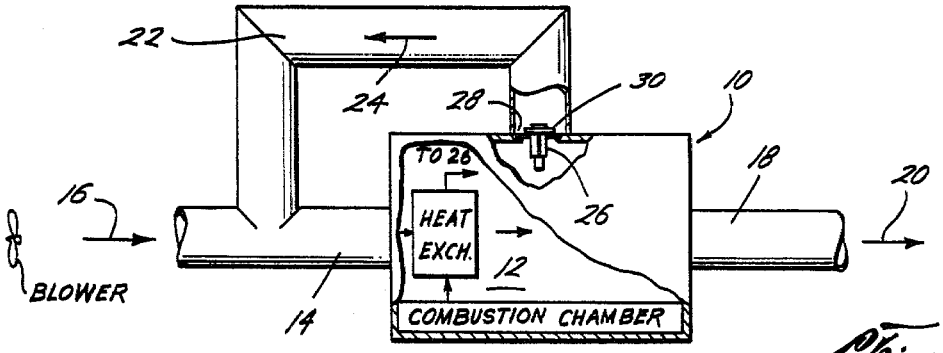
FIG. 1 is a schematic view of a furnace in which the gas recirculating system has been installed.

Referring to FIG. 1, reference numeral 10 is used to generally designate a typical gas-fired home furnace to which the hot combustion gas recirculation system, which is the subject of the invention, can be applied. The furnace 10 includes a plenum 12 into which air is circulated by an appropriate blower through a cold air return duct 14 as indicated by arrow 16. The air passes through a heat exchanger where hot combustion gases formed in a combustion chamber are circulated. The resultant hot air is exhausted from the plenum 12 through a hot air duct 18 as indicated by arrow 20 and into the house through other appropriate ducts. Air is returned to the furnace through the cold air return duct 14 for continuous recirculation of air in the house. This is a typical furnace arrangement well known to those with ordinary skill in the art so it will not be described in greater detail.

Hot combustion gases which pass through the heat exchanger are normally vented to the atmosphere through a flue which is connected between the furnace and a chimney. In accordance with the invention, instead of venting these hot combustion gases to the atmosphere a recirculation duct 22 connected to the furnace 10 receives the hot gases and recirculates them into the cold air return duct 14 as indicated by arrow 24.

Figure 2:
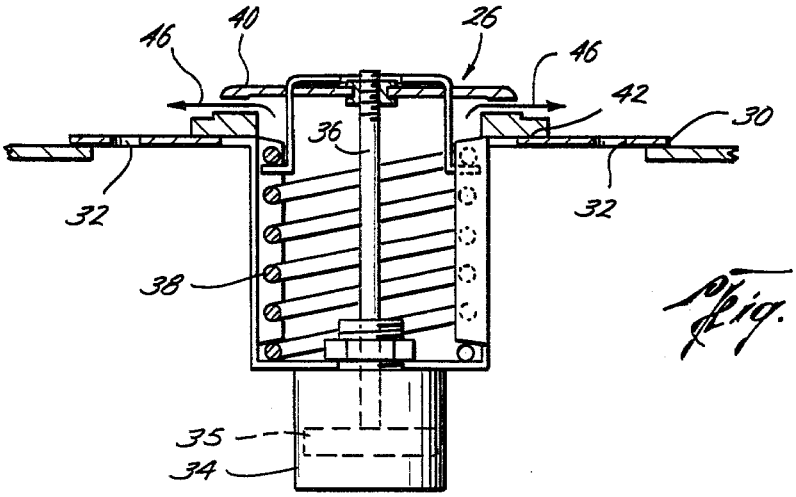
FIG. 2 is a sectional view of a thermostatic valve which can be used in conjunction with the gas recirculating system.
Figure 3:
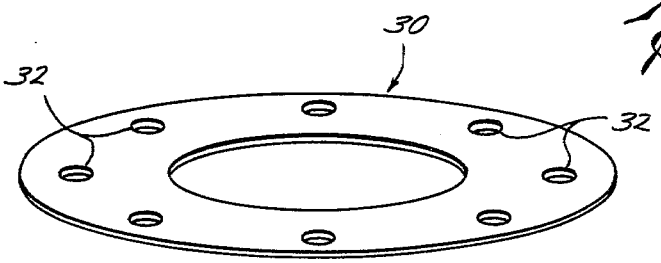
FIG. 3 is a perspective view of a support plate on which the thermostatic valve shown in FIG. 2 can be mounted and which shows, in particular, a plurality of bypass openings for allowing a predetermined minimum amount of hot combustion gases to escape from the combustion chamber when the thermostatic valve is closed.

A thermostatic valve 26, shown in detail in FIG. 2, is positioned in an opening 28 which leads from the combustion chamber to the recirculation duct 22. The valve 26 is seated on a support ring 30 which is shown in detail in FIG. 3. The support ring 30 includes a plurality of relief ports or openings 32 which, when the thermostatic valve 26 is closed, operates as a bypass and allows a predetermined amount of combustion gases to escape from the combustion chamber for preventing a pressure buildup from occurring inside the combustion chamber when the heat exchanger is being brought up to its operating temperature before the furnace blower (not shown) is switched on.

The thermostatic valve 26 is a commercially available item and includes a cup 34 filled with wax or the like which, when it reaches a predetermined temperature, expands to the point that it pushes a piston 35 upwardly forcing a rod 36 to overcome the force of a spring 38 and push a valve element 40 upwardly away from its valve seat 42 so that hot combustion gases can escape through ports 44 as indicated by arrows 46. Configurations other than the one shown in FIG. 2 can be used.

The valve is designed so that the ratio of the cross-sectional area of the duct 22 to the valve opening area is about 6.25:1. The ratio of the duct area to that of the holes 32 is about 16.33:1 and that of the opening 28 is about 2.6:1. The thermostatic valve 26 can simply sit on the mounting plate 30 as shown in FIG. 2 and does not have to be attached. Likewise, the mounting plate 30 can sit on the portion of the furnace 10 which defines the opening 28 since the weight of the thermostatic valve 26 and the mounting plate 30 are sufficient to withstand a pressure level above that which is likely to be reached within the combustion chamber. The thermostat can have temperature ranges which differ depending on the location in which it will be used. For example, in the southern part of the United States the opening temperature can be set at about 110° F., in the central states about 145° F., and in the northernmost states at about 185° F. The piston of the thermostatic valve can be designed to have a stroke of about ⅜" and to overcome a spring compression of about 45 pounds.

When the support ring 30 and thermostatic valve 26 are connected as shown in FIG. 2 so that hot combustion gases can be transmitted through the recirculation duct 22 to the cold air return duct 14, the cold air in the heat exchanger is warmed while the heat exchanger is brought up to its operating temperature. This pre-heating has been found to reduce the amount of fuel used by the furnace along with the fact that the temperature in the heat exchanger is raised more efficiently when most of the combustion gases are kept in the combustion chamber until they reached the predetermined maximum temperatures described above instead of being vented to the atmosphere. In this way, much less gas is consumed while the heat exchanger is brought up to its normal operating temperature. This typically takes about three minutes when the recirculating system is installed in a furnace. After the temperature of the heat exchanger reaches the proper level, the blower switches on and air is circulated through the heat exchanger. Hot combustion gases are also circulated through the heat exchanger which raises the temperature of the air and increases the efficiency of the furnace.

It has been found that since the combustion chamber does not communicate with the outside atmosphere, the amount of water vapor in the combustion chamber is significantly reduced. The lower water vapor level reduces acid buildup within the duct through which hot combustion gases are exhausted and eliminates the oxygen depletion problem within the combustion chamber so that when the furnace is properly adjusted incomplete combustion is avoided and little if any carbon monoxide is generated.

When a system such as the one which is the subject of the invention is installed on an existing furnace, several minor adjustments should be made for optimum operation. These include turning the main gas valve to ⅓-½ of its normal wide open position, adjusting the pilot light to its proper height relative to the thermocouple and opening the air valves on the burner inputs to their wide open positions. In addition, normally the combustion chamber has a thermostatic control which allows it to operate in a temperature range from between 100°-150° F. When the subject system is used, that operating temperature range should be adjusted downward for the same heating effect on the house to 90°-120° F.

When the system is installed on a furnace, the furnace will operate as follows. When the thermostatic valve 26 is closed a small draft will flow through the combustion chamber from a draft vent through the openings 22. When the thermostat in the house signals a demand for heat, gas and air are introduced into the burners and ignited which heats the combustion chamber and causes a sudden increase in pressure within the combustion chamber. The pressure is partially relieved through the openings 32 so that the burners will not be blown out. While the combustion chamber heats up, the hot flue gases flow through the openings 22 and recirculation duct into the cold air return duct 14, peheating the cold air before it reaches heat exchanger. The thermostatic valve 26 remains closed until the temperature inside the combustion chamber reaches one of the predetermined temperatures mentioned above, the retention of the hot flue gases within the combustion chamber providing for a more efficient utilization of energy for raising the temperature of the heat exchanger. Just before the blower is switched on, about three minutes after the burners are ignited, the thermostatic valve will open allowing more hot gas to flow into the cold air return and be circulated with the heated air. When the thermostat in the living area of the house indicates no more heat is necessary, the gas burners are swiched off and although the blower continues the run the thermostatic valve will then close again locking heat in the combustion chamber for providing longer period of elevated temperature in in the heat exchanger.

Thus, a relatively simple system is provided which significantly increases the efficiency of gas-fired home furnaces. Although many people thought that hot combustion gases could not be circulated along with the heated air, it has been found unexpectedly that by eliminating the normal connection between the combustion chamber and the atmosphere, the reduction of water vapor within the combustion chamber results in a significantly lower level of carbon monoxide than expected so that there is no danger when the combustion gases are circulated through the house. In addition, by providing the pressure relief openings 32 along with the other adjustments described above, the burners will remain lighted due to the increased pressure in the combustion chamber.

The foregoing disclosure and description of the invention are illustrative and explanatory thereof, and various changes in the size, shape and materials as well as in the details of the illustrated construction may be made without departing from the spirit of the invention and all such changes are contemplated as falling within the scope of the appended claims.

I claim:

1. Combustion gas recirculating system for a gas-fired furnace of the type which includes a plenum with a cold air inlet duct and a warm air exhaust duct, a combustion chamber where gas is burned to form hot combustion gases, a heat exchanger in the plenum for receiving the hot combustion gases and including a surface configuration past which air can flow and be heated, an outlet in the heat exchanger for the hot combustion gases, and a blower for moving air through the plenum and past the heat exchanger, the invention comprising:

(a) a recirculation duct connecting the combustion gas outlet with the cold air inlet duct;

(b) a thermostatically controlled valve for regulating the flow of hot combustion gases from the combustion gas outlet to the cold air inlet duct by opening when the hot combustion gases reach a predetermined temperature and closing when the hot combustion gases are below said predetermined temperature; and (c) bypass means for allowing a pedetermined minimum amount of hot combustion gases to flow to the cold air inlet duct when the thermostatic valve is closed.

2. The system of claim 1, wherein the thermostatic valve includes a reservoir filled with expandable wax, a piston in the wax which moves when the wax expands and contracts, a valve connected to the piston, and a spring which normally urges the valve closed but which can be overcome to open the valve when the wax is heated and expands.

3. The system of claim 1, wherein the bypass means includes a circular plate with an opening in the middle in which the thermostatic valve is mounted, the plate including a plurality of bypass openings.

4. The system of claim 3, wherein the ratio of the cross-sectional area of the recirculation duct to the collective area of the bypass openings is about 16.33:1.

5. The system of claim 1, wherein the ratio of the cross-sectional area of the recirculation duct to the area of the valve opening is about 6.25:1.

6. The system of claim 3, wherein the ratio of the cross-sectional area of the recirculation duct to the middle opening of the plate is about 2.6:1.

7. The system of claim 1, wherein the blower is set to be switched on when the heat exchanger reaches a predetermined operating temperature and the thermostatic valve is designed to open a short time before the blower is switched on.

8. A hot combustion gas recirculation system which can be retro-fitted on a gas-fired furnace of the type which includes a combustion chamber where gas is burned to form hot combustion gases, a plenum including a cold air inlet and warm air outlet, a heat exchanger in the plenum for receiving the hot combustion gases and including a surface configuration past which air can be circulated and heated, an outlet in the heat exchanger for the hot combustion gases, ducts connected to the heat exchanger inlet and outlet, and a fan for circulating air through the heat exchanger, the system comprising a support member adapted to fit in the combustion gas outlet, a thermostatically-controlled valve mounted on the support member for regulating the flow of hot combustion gases from the furnace to the heat exchanger inlet by opening when the hot combustion gases reach a predetermined temperature and closing when the hot combustion gases fall below said predetermined temperature, the support member including at least one opening for allowing a predetermined minimum amount of combustion gases to flow to the heat exchanger inlet when the thermostatic valve is closed, and a recirculating duct for connecting the combustion gas outlet to the duct connected to the heat exchanger inlet.

9. The system of claim 8, wherein support member includes a circular plate with an opening in the middle for receiving the thermostatic valve and a plurality of bypass openings.

10. The system of claim 8, wherein the thermostatic valve includes a reservoir filled with expandable wax, a piston in the wax which moves when the wax expands and contracts, a valve connected to the piston, and a spring which normally urges the valve closed but which can be overcome to open the valve when the wax is heated and expands.

11. A method for recirculating combustion gases of a gas-fired furnace of the type which includes a plenum with a cold air inlet duct and a warm air exhaust duct, a combustion chamber where gas is burned to form hot combustion gases, a heat exchanger in the plenum for receiving the hot combustion gases and including a surface configuration past which air can flow and be heated, an outlet in the heat exchanger for the hot combustion gases, and a blower for moving air through the plenum and past the heat exchanger, the method comprising the steps of:

(a) recirculating hot combustion gas from the combustion chamber to the cold air inlet duct through a thermostatically controlled valve which opens when the hot combustion gases reach a predetermined temperature and closes when the hot combustion gases are below said predetermined temperature;

(b) allowing a predetermined minimum amount of hot combustion gases to bypass the thermostatic valve and flow to the cold air inlet when the valve is closed.

12. The method of claim 11, wherein the blower is set to be switched on when the heat exchanger reaches a predetermined operating temperature and the thermostatic valve is designed to open a short time before the blower is switched on.

* * * * *